US005935348A

United States Patent [19]

Rossmaier

[11] Patent Number: 5,935,348

[45] Date of Patent: Aug. 10, 1999

[54] COMPOSITION AND PROCESS FOR PREVENTING CORROSION AND REDUCING FRICTION ON METALLIC SURFACES

[75] Inventor: Henry Rossmaier, Duesseldorf, Germany

[73] Assignee: Henkel Kommanditgesellschaft auf Aktien, Duesseldorf, Germany

[21] Appl. No.: 08/849,411

[22] PCT Filed: Nov. 14, 1995

[86] PCT No.: PCT/EP95/04469

§ 371 Date: May 23, 1997

§ 102(e) Date: May 23, 1997

[87] PCT Pub. No.: WO96/16205

PCT Pub. Date: May 30, 1996

[51] Int. Cl.[6] ..... C23C 22/00

[52] U.S. Cl. ..... 148/243; 148/246; 148/252; 148/260; 427/388.2

[58] Field of Search ..... 148/243, 246, 148/252, 260; 427/388.2

[56] References Cited

U.S. PATENT DOCUMENTS

| | | | |
|---|---|---|---|
| 4,017,334 | 4/1977 | Matsushima et al. | 148/6.15 R |
| 4,273,592 | 6/1981 | Kelly | 148/6.27 |
| 4,470,853 | 9/1984 | Das et al. | 148/6.12 Z |
| 4,954,372 | 9/1990 | Sako et al. | 427/388.2 |
| 4,992,116 | 2/1991 | Hallman | 148/247 |
| 5,064,500 | 11/1991 | Awad | 156/665 |
| 5,158,622 | 10/1992 | Reichgott et al. . | |
| 5,458,698 | 10/1995 | Bershas et al. | 148/246 |

FOREIGN PATENT DOCUMENTS

| | | |
|---|---|---|
| 0 008 942 | 6/1983 | European Pat. Off. . |
| 612 833 | 8/1994 | European Pat. Off. . |
| 24 46 492 | 4/1975 | Germany . |
| 05 320936 | 12/1993 | Japan . |
| 875 972 | 8/1961 | United Kingdom . |
| 2 059 445 | 4/1981 | United Kingdom . |
| WO 85/05131 | 11/1985 | WIPO . |
| WO 91/14014 | 9/1991 | WIPO . |
| WO 92/07973 | 5/1992 | WIPO . |
| WO 94/01517 | 1/1994 | WIPO . |
| WO 95/02660 | 1/1995 | WIPO . |

OTHER PUBLICATIONS

Röpp's Chemie Lexikon, 9th edition, 1992, pp. 4452–4453, Keyword "Tannin".

Kirk–Othmer "Encyclopedia of Chemical Technology", 2nd edition, vol. XII (1967), pp. 303–341.

*Primary Examiner*—John Sheehan
*Assistant Examiner*—Andrew L. Oltmans
*Attorney, Agent, or Firm*—Ernest G. Szoke; Wayne C. Jaeschke; Norvell E. Wisdom, Jr.

[57] ABSTRACT

Aqueous acid treatment solution for the treatment of beverage cans, in particular of aluminum, for producing a corrosion-protective, friction-reducing coating which improves the ability to be enameled, which comprises 0.14 to 2.25 mmol/l of an alkylamine oxide or an alkylammonium salt with an alkyl radical having 8 to 22 C atoms, 0.25–1.5 mmol/l of hydroxycarboxylic acids having 4–7 C atoms, complex fluorides and mineral acids, and preferably tannin.

20 Claims, No Drawings

COMPOSITION AND PROCESS FOR PREVENTING CORROSION AND REDUCING FRICTION ON METALLIC SURFACES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to the field of surface treatment of shaped metal components of aluminum or aluminum alloys and of tin-plated steel (tinplate). It relates in particular to beverage and food cans of these materials. The invention pursues the aim of providing the can surfaces, during the can production process, with a corrosion-protective layer which can be enameled over, which facilitates running off of water and in particular leads to a reduction in the coefficient of friction between cans in contact with one another and therefore facilitates transport of the cans on conveyor belts, the porosity of a later coat of enamel being reduced at the same time.

Cans of tin-plated steel (tinplate) and of aluminum (or of aluminum alloys, which are included under "aluminum" in the following for simplicity) are widely used for storage of foods and especially of beverages. In the can production process, after shaping these are usually washed; for this, acid or alkaline cleaning agents, for example, are commercially obtainable. These cleaning agent solutions must have an adequate dissolving power for the metals in question in order to remove abraded metal from the cans effectively. The can surface can itself be roughened by the attack on the metal; this increases the friction between cans in contact. The speed of transport of cans on conveyor belts is thereby reduced, and especially at points where a back-up of the cans develops due to separation of the cans, can transport may become blocked completely. Since the capacity of the production line is thereby reduced, efforts are made to condition the can surfaces such that friction between cans in contact is as low as possible.

However, application of a friction-reducing layer should not mean that the adhesion of enamel coatings, labelling or other coatings applied for corrosion protection and/or for decorative reasons suffers. Furthermore, the coating must ensure that requirements in respect of corrosion resistance, which vary according to the contents of the cans, are met. Only those active compounds which are generally ecologically acceptable and in particular acceptable for foods should be employed here. For example, efforts are made to avoid chromium-containing reagents for environmental reasons.

Various chromium-free processes for the surface treatment of aluminum, which as a rule employ inorganic acids, in particular phosphoric acid, hydrofluoric acid or other sources of fluoride and/or complex fluorides and which operate with or without the additional use of organic polymers are known in the prior art. For example, U.S Pat. No. 4,992,116 describes an aqueous acid treatment solution which comprises phosphate, a fluoroacid of Zr, Ti, Hf or Si and a polyphenol compound which is a Mannich adduct of a substituted amine onto a polyalkylenephenol or a tannin.

EP-B-8942 discloses treatment solutions, preferably for aluminum cans, comprising a) 0.5 to 10 g/l of polyacrylic acid or of an ester thereof and b) 0.2 to 8 g/l of at least one of the compounds hexafluorozirconic acid, hexafluorotitanic acid or hexafluorosilicic acid.

U.S. Pat. No. 4,470,853 discloses conversion solutions for aluminum which comprise, inter alia, 10 to 150 ppm of zirconium, 20 to 250 ppm of fluoride, 15 to 100 ppm of phosphate and 30 to 125 ppm of tannin. Their pH is in the range from 2.3 to 2.95. The use of tannin in the surface treatment of aluminum is also disclosed in DE-A-24 46 492, according to which aluminum is treated with an acidic, phosphate-containing solution which comprises a metal salt of tannin in amounts of between 0.1 and 10 g/l.

Various solutions have already been proposed for reducing the friction between aluminum cans during transport of the cans. For example, W091/14014 describes an aqueous solution which comprises ions of Fe, Zr, Sn, Al or Ce, metal-etching acids, such as, for example, hydrofluoric acid, alkoxylated phosphoric acid esters and a combination of alkoxylated alcohols and alkoxylated alkylphenols. WO94/01 517 describes a process for friction-reducing conversion treatment of metal cans in which alkoxylated or non-alkoxylated castor oil triglycerides, hydrogenated castor oil derivatives, alkoxylated or non-alkoxylated amine salts of fatty acids, alkoxylated or non-alkoxylated amino-fatty acids, alkoxylated or non-alkoxylated fatty amine N-oxides, alkoxylated or non-alkoxylated quaternary ammonium salts or water-soluble organic polymers are employed, in addition to inorganic metal compounds. Those amine oxides or quaternary ammonium salts in which at least one radical contains up to 20 carbon atoms are employed here. Amine compounds of this type are also employed in the context of the present invention. EP-A612 833 proposes a surface treatment with an ester between a polyglycerol and fatty acids for reducing friction.

BRIEF SUMMARY OF THE INVENTION

Effective surface treatment of tinplate or aluminum cans should on the one hand meet the various requirements with respect to corrosion protection as well as absence of pores and adhesion of a subsequent enamel coating, each of which is tested by different criteria according to the various requirements, and on the other hand ensure a reduction in friction which is as effective as possible. Systems known to date are in each case compromises between the various requirements and are not completely satisfactory in all particular points. The object of the present invention is to provide a solution for the surface treatment of metal cans which has an improved performance spectrum with respect to the various requirements. In particular, it has been found that in processes for conversion treatment and reducing friction according to WO94/01517, in which fatty amine N-oxides or quaternary fatty alkylammonium salts are employed as friction-reducing active compounds, the porosity of a subsequent enamel coating does not reliably meet the requirements, especially of the beverage industry.

The object is achieved by an aqueous solution for the treatment of surfaces of aluminum or tin and, in each case, alloys thereof, which has a pH in the range from 2.3 to 3.3 and comprises at least the following components:

a) 0.14 to 2.25 mmol/l of a component chosen from surface-active quaternary ammonium salts or amine oxides of the general formula (I):

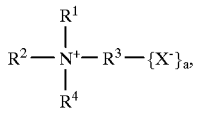

(I)

in which $R^1$ is a saturated or a mono- or polyunsaturated alkyl radical having 8 to 22 C atoms, $R^2$ and $R^3$ independently of one another are an alkyl or hydroxyalkyl radical having 1 to 8 C atoms or an aryl or alkylaryl radical having 6 to 10 C atoms, $R^4$ is a radical of the type $R^2$ or $R^3$ or an $—O^-$ radical and $X^-$ is a monovalent anion or a monovalent equivalent of a polyvalent anion, and a is 0 if $R^4$ is an $—O^-$ radical, and otherwise a is 1, b) 0.25 to 1.5 mmol/l of one or more mono-, di- or tri-basic hydroxycarboxylic acids having 4 to 7 C atoms in the molecule, the sum of hydroxyl and carboxyl groups being at least 3, or in each case anions thereof, c) 0.4 to 2 mmol/l of one or more complex fluorides and d) 20 to 500 mg/l of mineral acids chosen from phosphoric acid, nitric acid and sulfuric acid, or in each case anions thereof.

DETAILED DESCRIPTION OF THE INVENTION

The alkyl radicals $R^1$ here can be radicals of a certain chain length and a certain number of double bonds. For economic reasons, however, it is preferable to employ amine oxides or ammonium salts which are derived from fatty chemical raw materials. In these cases, the radicals $R^1$ have a distribution of chain lengths and double bonds such as are characteristic for the fatty acids in plant or animal fats and oils. Those compounds of the general formula (I) are preferably employed in which $R^1$ is a mixture of alkyl groups, as in those fatty acid mixtures which can be obtained by hydrolysis of coconut oil, palm kernel oil or animal tallow.

Examples of suitable amine oxides of the general formula (I) are: bis(2-hydroxyethyl)coconut alkylamine oxide (Aromox® T/12), bis(2-hydroxyethyl)tallow alkylamine oxide (Aromox® T/12), dimethylcoconut alkylamine oxide (Aromox® DMC), hydrogenated dimethyl-tallow alkylamine oxide (Aromox® DMHT) and dimethylhexadecylamine oxide (Aromox® DM-16), all of which are obtainable from Akzo Chemicals Inc.

Examples of suitable quaternary ammonium salts of the general formula (I) are: dodecyltrimethylammonium chloride (Arquad® 12-37W), octadecyltrimethylammonium chloride (Arquad® 18–50), dimethylbenzyl($C_{12-18}$)-alkylammonium chloride (Arquad® B-100), tris(2-hydroxyethyl)-tallow-alkylammonium acetate (Ethoquad® T/13) and methyl-bis(2-hydroxy-2-methylethyl)ammonium ethyl sulfate (Propoquad® T/12), all of which are likewise obtainable from Akzo Chemicals Inc.

Those alkylamine oxides or quaternary ammonium salts of the general formula (I) which carry radicals $R^2$, $R^3$ and in the case of the quaternary ammonium salts also $R^4$ which are formed when alkylamines are reacted with ethylene oxide, propylene oxide or butylene oxide are preferred here. Examples of these are 2-hydroxyethyl groups and 2-hydroxy-2-methylethyl groups. As is customary in alkoxylation reactions, radicals $R^2$, $R^3$ and $R^4$ in which in each case several alkoxy groups are linked to one another via ether bonds can also be formed in this reaction. Such polyether radicals having up to 8 C atoms likewise lie within the scope of the invention. However, those compounds of the general formula (I) which carry 2-hydroxyethyl groups as radicals $R^2$, $R^3$ and if appropriate $R^4$ are particularly preferred.

In the treatment solutions according to the invention, the components of group a) are the active compounds having a friction-reducing action. In contrast, the effect of components of group b), mono-, di- or tri-basic hydroxycarboxylic acids having 4 to 7 C atoms in the molecule, the sum of hydroxyl and carboxyl groups being at least 3, chiefly lies in the fact that an enamel applied later has a reduced porosity and therefore an increased corrosion resistance. The porosity value, called "metal exposure value", MEV, in English-language literature, can be determined by electrochemical measurement and is one of the quality requirements of the beverage industry for enameled beverage cans. This measurement parameter can be determined, for example, with an "Enamel Rater MK" from Manfred Konke, Berlin (Germany) or with an "Enamel Rater" from Wilkens-Anderson Co., Chicago, Ill. The measurement is based on filling the beverage can, enameled on the inside, with an electrolyte solution (50.6 g of sodium chloride and 1.19 g of dioctyl-sodium sulfosuccinate in 5 l of completely deionized water) and connecting the can as electrode. A counter-electrode is immersed in the electrolyte solution and, after the voltage has been switched on and after a waiting time of 4 seconds, the current which flows is read off in mA. If the coating of the can is perfect, no current flow is to be expected. An increase in current flow in mA, which is the "metal exposure value", indicates an increasing permeability of the coating to ions, which can be interpreted as porosity. For later filling with soft drinks, for example, the requirement is that the average MEV should be less than 5 mA at a test voltage of 6.3 V.

The core of the present invention is that the components b) in the treatment solution significantly reduce the MEV without adversely influencing the other properties, such as reduction in friction and corrosion protection, which are essentially to be attributed to components a), c) and d) of the treatment solution.

Examples of suitable hydroxycarboxylic acids are malic acid, tartaric acid, citric acid and in particular those carboxylic acids which can be obtained by oxidation of sugars of the pentose and hexose type. Examples of such acids are gluconic acid, saccharic acid, mannosaccharic acid, mucic acid and glucuronic acid. Gluconic acid is particularly preferred. These acids can be employed as such or in the form of their water-soluble salts, in particular their sodium salts. At the pH of the treatment solutions according to the invention in the range from 2.3 to 3.3, the hydrocarboxylic acids are partly present as such and partly in the form of their anions, depending on their $pK_a$ value. The co-use of such carboxylic acids, in particular gluconic acid, in the surface treatment of aluminum, for example during alkaline pickling, is known in principle. However, the effect, that the hydroxycarboxylic acids of group b) supplement the action of other components of the treatment solution according to the invention such that the "metal exposure value" of an enamel coating applied is reduced, is unexpected.

The other main components of the treatment solution according to the invention, c) and d), are well-known in solutions for conversion treatment of aluminum surfaces. Possible complex fluorides of group c) are, for example, hexafluorotitanate, hexafluorozirconate, hexafluorohafnate, hexafluorosilicate or tetrafluoroborate. The use of hexafluorozirconate is preferred. It is irrelevant whether the complex fluorides are employed as water-soluble salts, for example as sodium or ammonium salts, or as free acids. It must merely be ensured that the complex fluoro compounds are combined with the mineral acids of group d) or acid or neutral salts thereof such that the treatment solution according to the invention has a pH in the active range from 2.3 to 3.3. At pH values outside this range, the formation of the corrosion-protective and friction-reducing layer aimed for is more unsatisfactory the further the pH is removed from the stated range.

Since the phosphoric acid or anions thereof have a particular corrosion-protective action due to the formation of sparingly soluble metal phosphates which adhere firmly to the metal surface, it is particularly preferable for component d) to comprise phosphoric acid or anions thereof to the extent of 10 to 100% by weight. If phosphoric acid is not employed as the only acid of group d), the co-use of nitric acid or anions thereof is advantageous.

The action of the substance combination described above can be intensified by addition of other active compounds from the prior art:

An addition of tannin in the concentration range from 50 to 500 mg/l increases the action of the hydroxycarboxylic acids of group b) with respect to reduction of the "metal exposure value" of an enamel coating subsequently applied. It is accordingly preferable for the treatment solution according to the invention additionally to comprise tannin. Tannins (compare, for example, Römpp Chemie Lexikon (R ömpp Chemical Dictionary), 9th edition 1992, keyword "tannin") is a collective name for a series of naturally occurring polyphenols of very diverse composition which can be derived from gallic acid. The gallic acid derivatives are often present in a form esterified with glucose. In the form of plant extracts of varying origin, tannins are a known group of active compounds for tanning leather. In this connection, the structures and origin of tannins are discussed in more detail in: Kirk-Othmer *Encyclopedia of Chemical Technology,* 2nd edition, volume XII (1967), pages 303–341. As can be seen from the documents U.S. Pat. No. 4,470,853 and DE-A-24 46 492, the use of tannins has already been proposed for surface treatment of aluminum.

Experience has shown that the presence of free fluoride ions has a favorable effect during production of conversion layers on aluminum surfaces. Free fluoride ions, which are present at least partly in the form of non-dissociated hydrofluoric acid at the pH of the treatment solution, can be formed from the complex fluorides listed above under group c) by hydrolysis reactions in the treatment solution. The layer formation achieved with the treatment solutions according to the invention can be assisted, especially in the start-up phase of the baths, if the treatment solutions additionally comprise 10 to 100 mg/l of fluoride ions, which can be added as hydrofluoric acid or as soluble neutral or acid fluorides. Examples of these are NaF, KF, $KHF_2$ or $(NH_4)HF_2$. The fluoride component is to be chosen such that the pH does not leave the required range of 2.3 to 3.3.

Since the treatment solution comprises surface-active components which tend to foam due to the components of group a), it may be necessary to add defoamer to the treatment baths in the event of vigorous agitation of the bath, such as, for example, for spray units. Amounts in the range from 50 to 500 mg/l should be adequate as a rule. Suitable defoamers are, for example, alkyl-polyalkoxy esters. A suitable polyalkoxy ester of this type is obtainable under the tradename Foamaster® C14 from Henkel KGaA, D üsseldorf (Germany).

All the ranges stated above for active concentrations and the pH are to be understood as meaning that the desired action occurs reliably within these parameter ranges. If the concentrations fall below the minimum concentrations stated, the desired combined action of the protective layer of reduction in friction, corrosion protection and reduction in the porosity of a subsequent enamel coating as a rule decreases. Exceeding the maximum concentrations is at least uneconomical, but may also lead to disadvantages in the formation of the layer. A coating which meets the requirements entirely is obtained particularly reliably if component a) is present in the treatment solution in concentrations of 0.5 to 1.1 mmol/l and/or component b) is present in the treatment solution in concentrations of 0.3 to 1.15 mmol/l. The tannin preferably co-used is preferably employed in concentrations of 100 to 400 mg/l.

A further improvement in the coating, in particular with respect to its ability to be over-enameled, can be achieved by additionally adding water-soluble or water-dispersible organic polymers to the treatment solution in concentrations of about 100 to about 1000 mg/l. These polymers can be chosen from h) homo- or hetero-polymers of ethylene oxide, propylene oxide and/or butylene oxide, i) homo- or hetero-polymers of acrylic acid, maleic acid and/or derivatives thereof, k) homo- or hetero-polymers of vinylphenol and/or vinylphenol derivatives, and l) homo- or hetero-polymers of vinyl alcohol and/or vinyl alcohol derivatives. Polymers of the type mentioned are commercially obtainable. The polyvinylphenol derivatives of group k) are obtainable by a Mannich reaction of polyvinylphenol with aldehydes and alkylamines. A reaction product of poly(4-vinylphenol) with formaldehyde and 2-alkylamino-1-ethanol may be mentioned as an example. Further details on this polymer and its use in the surface treatment of aluminum are contained in WO92/07973.

Compositions of ready-to-use treatment solutions according to the invention have been described above. It is of course possible for these baths to be prepared directly at the place of use by mixing the individual components together in the stated concentration ranges. For the user of such treatment solutions, however, it is more favorable to obtain aqueous concentrates of the treatment solutions from a manufacturer and to adjust these on site to the concentration ranges of the use solutions by dilution with water. The invention accordingly also relates to aqueous concentrates of the treatment solutions which give the treatment solutions according to the invention by dilution with water. It is technically and economically the most attractive here to formulate the concentrates such that the ready-to-use treatment solutions can be obtained from them by dilution with water in a volume ratio of between 1:50 and 1:200. For example, the concentrate can be formulated such that it must be diluted with water in the ratio of 1:100 for preparation of the ready-to-use treatment solution.

The treatment solution according to the invention is preferably employed in a process for the production of cans, in particular beverage cans of aluminum. alloys. In this process, the preshaped cans are as a rule subjected to a one- or two-stage acid or alkaline cleaning, after which they are usually rinsed with tap water. Thereafter, the cans are brought into contact with the treatment solution according to the invention, which can be effected, for example, by dipping the cans in the solution or by spraying the cans with the solution. The temperature of the treatment solution here should be in the range between 30 and 60° C., in particular from 40 to 45° C. The duration of treatment should not fall below 10 seconds. A duration of treatment of more than 120 seconds provides no technical advantage. For example, it is favorable to choose a duration of treatment of about 30 seconds. Thereafter, the cans are rinsed with tap water and then with completely deionized water, after which they can be dried and enameled. The invention accordingly also relates to a process for the production of a corrosion-protective, friction-reducing, protective layer, which improves the ability to be enameled, on surfaces of aluminum or tin and in each case alloys thereof, which comprises bringing the surfaces into contact with an aqueous solution according to this invention, which has a temperature in the range from 30 to 60° C., for a period of between 10 and 120 seconds, the process preferably being employed for the treatment of cans of aluminum or aluminum alloys.

The invention has been tested on aluminum beverage cans having a volume of between 330 and 350 ml, such as are customary for soft drinks. The. preshaped cans were first cleaned (acid cleaning agent Ridoline® 124, Henkel KGaA, Düsseldorf; 54 to 60° C., 1 minute) and were then rinsed with tap water at room temperature. The surface treatment was then carried out with treatment solutions according to the invention and with comparison solutions, as shown in the table, with pH values in the range between 2.45 and 2.93 at temperatures of between 40 and 45° C. for a treatment duration of 30 seconds by spraying. Rinsing with tap water was then carried out, followed by rinsing with completely deionized water, in each case at room temperature, after which the cans were dried at 150° C. for 5 minutes.

The resistance to mineral water, which provides a measure of the corrosion protection of the treated cans, was determined by standard methods on the non-enameled cans. Non-enameled cans were also used for the coefficient of friction determination below. For determination of the enamel porosity, expressed as the "metal exposure value", the insides of the cans were enameled with a commercially available enamel (Dexter Ecodex 4020) with an enamel application of 120 to 130 mg/can.

The resistance to mineral water was determined by immersing the non-enameled cans into a hot solution, at 66° C., of 0.2 g/l of sodium tetraborate decahydrate for 30 minutes, subsequently rinsing them with completely deionized water and drying them at 105° C. in a drying oven. The bases of the cans were then evaluated visually for their degree of discoloration. No discoloration or slight discoloration is regarded as acceptable here, and a dark or irregular discoloration is regarded as unacceptable. Both the cans treated by the process variants according to the invention and the cans treated by comparison processes according to the prior art passed this test for corrosion resistance.

The surface friction of the nonenameled beverage cans was determined on a tilting table. In each case 3 cans treated in the same way are used for this. Two cans are arranged lying parallel on the tilting table such that their longitudinal axis is perpendicular to the tilting axis. A third can is placed on this pair of cans, with its longitudinal axis perpendicular to the tilting axis, such that the third can is displaced by about 0.5 cm in the direction of the tilting axis with respect to the lower cans, the third can being placed with the open side in the direction of the tilting axis, in contrast to the lower cans. The tilting table is then tilted automatically at a constant rate, and the angle of inclination a at which the top can slips and thereby touches a circuit breaker is determined. The tangent of the angle of inclination $\alpha$ at which slipping occurs is called the coefficient of friction. To obtain statistically confirmed results, in each case 6 cans treated in the same way are used, from which in each case 3 are chosen for one experiment. Six measurements, independent of one another, are carried out with different can combinations. The mean of these 6 measurements is determined. The coefficients of friction determined with the treatment solutions according to the invention and the comparison solutions according to the prior art showed no significant differences and were in the range from 0.476 to 0.514.

In contrast, the effect of the treatment according to the invention over treatment without addition of hydroxycarboxylic acids of group b) manifests itself in a clearly reduced porosity of an enamel coating, which was determined as the "metal exposure value" (MEV). The determination was carried out on cans, enameled on the inside, in accordance with the operating instructions of the Enamel Rater MK from Manfred Kunke, Taunusstr. 29, Berlin (Germany) at a test voltage of 6.3 volts. The cans connected as electrodes were filled with an electrolyte solution (50.6 g of sodium chloride and 1.19 g of dioctyl-sodium sulfosuccinate in 5 l of completely desalinated water), in which a metal hoop was immersed as the counter-electrode. After application of the voltage, the current was measured in mA after 4 seconds and taken as the MEV value. An upper MEV value of 5 mA is stated as the test criterion for beverage cans for soft drinks. The results obtained are entered in the table. The table also contains the number of cans measured in each case per treatment solution, the mean MEV value, the maximum MEV value found and the number of cans in which the specification of a maximum MEV value of 5 mA was exceeded. The composition of the test solutions can be seen from the table.

Table: Treatment solutions and "Metal Exposure Value" (MEV)

Basic recipe:

400 mg/l of tris(2-hydroxyethyl)-tallow-ammonium acetate
145 mg/l of hexafluorozirconic acid
66 mg/l of phosphoric acid
266 mg/l of nitric acid
32 mg/l of hydrofluoric acid
200 mg/l of defoamer (alkyl-polyalkoxy ester, Foamaster® C14, Henkel KGaA, Düsseldorf)

Additions of sodium gluconate and tannin

| Experiment No. | Sodium-gluconate (mg/l) | Tannin (mg/l) | No. of cans | Average MEV (mA) | Maximum MEV (mA) | Cans with MEV >5 mA |
|---|---|---|---|---|---|---|
| Comparison | — | — | 8 | 5.5 | 42.1 | 1 |
| Example 1 | 67 | — | 8 | 3.9 | 17.7 | 2 |
| Example 2 | 133 | — | 7 | 1.3 | 6.0 | 1 |
| Example 3 | 200 | — | 8 | 2.1 | 6.0 | 1 |
| Example 4 | 125 | — | 9 | 1.25 | 6.4 | 1 |
| Example 5 | 125 | 83 | 8 | 4.0 | 11.4 | 1 |
| Example 6 | 125 | 167 | 7 | 0.6 | 2.3 | 0 |
| Example 7 | 125 | 250 | 9 | 0.2 | 0.8 | 0 |

The invention claimed is:

1. An aqueous solution for the treatment of surfaces of aluminum or tin or alloys of aluminum or tin, said aqueous solution having a pH in the range from 2.3 to 3.3 and comprising at least the following components:

a) 0.14 to 2.25 mmol/l of a component chosen from surface-active quaternary ammonium salts or amine oxides of the general formula (I)

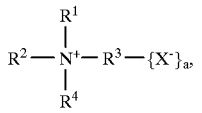

(I)

in which; $R^1$ is a saturated or a mono- or polyunsaturated alkyl radical having 8 to 22 C atoms; each of $R^2$ and $R^3$ independently of each other is an alkyl or hydroxyalkyl radical having 1 to 8 C atoms or an aryl or alkylaryl radical having 6 to 10 C atoms; $R^4$ is an alkyl or hydroxyalkyl radical having 1 to 8 C atoms, an aryl or alkylaryl radical having 6 to 10 C atoms, or an $—O^-$ radical; $X^-$ is a monovalent anion or a monovalent equivalent of a polyvalent anion; a is 0 if $R^4$ is an $—O^-$ radical; and otherwise a is 1.

b) 0.25 to 1.5 mmol/l of one or more mono-, di- or tri-basic hydroxycarboxylic acids having 4 to 7 C atoms in each molecule, the sum of hydroxyl and carboxyl groups in each molecule being at least 3, or anions thereof, c) 0.4 to 2 mmol/l of one or more complex fluorides and d) 20 to 500 mg/l of mineral acids selected from the group consisting of phosphoric acid, nitric acid and sulfuric acid, or anions thereof.

2. An aqueous solution as claimed in claim 1, which additionally comprises one or more of the following components:

e) 50 to 500 mg/l of tannin, 10 to 100 mg/l of hydrofluoric acid or fluoride ions; and g) 50 to 500 mg/l of defoamer.

3. An aqueous solution as claimed in claim 2, in which at least one of the following conditions is satisfied:

component a) is an amine oxide or a quaternary ammonium salt in which $R^1$ represents a mixture of alkyl groups having the same numbers of the same alkyl groups as are present in primary amines made by reducing with ammonia and hydrogen a fatty acid mixture which has been obtained by hydrolysis of coconut oil, palm kernel oil or animal tallow;

component b) is selected from the group consisting of mono- and di-basic hydroxycarboxylic acid molecules having 6 C atoms and at least 4 hydroxyl groups each;

component c) is hexafluorozirconic acid; and component d) comprises phosphoric acid or anions thereof to an extent of 10 to 100% by weight.

4. An aqueous solution as claimed in claim 3, in which at least one of the following conditions is satisfied:

component a) is selected from the group consisting of quaternary ammonium salts in which $R^2$, $R^3$ and $R^4$ are hydroxyalkyl groups having 1 to 4 C atoms; and component b) is gluconic acid or anions thereof.

5. An aqueous solution as claimed in claim 4, which comprises component a) in a concentration of 0.5 to 1.1 mmol/l or component b) in a concentration of 0.3 to 1.15 mmol/l.

6. An aqueous solution as claimed in claim 5, which comprises tannin in a concentration of 100 to 400 mg/l.

7. An aqueous solution as claimed in claim 6, which additionally comprises water-soluble or water-dispersible polymers in a concentration of 100 to 1000 mg/l.

8. An aqueous solution as claimed in claim 7, in which the water-soluble or water-dispersible polymers are selected from the group consisting of h) homo- and hetero-polymers of ethylene oxide, propylene oxide and butylene oxide, i) homo- and hetero-polymers of acrylic acid, maleic acid and derivatives thereof, k) homo- and hetero-polymers of vinylphenol and products of Mannich reactions of homo- and hetero-polymers of vinylphenol, aldehydes, and alkyl amines, and l) homo- and hetero-polymers of vinyl alcohol and vinyl alcohol derivatives.

9. An aqueous concentrate which by being diluted with water in a volume ratio of between 1:50 and 1:200 produces an aqueous solution comprising:

a) 0.5 to 1.1 mmol/l of a component chosen from surface-active quaternary ammonium salts or amine oxides of the general formula (I):

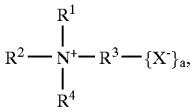

(I)

in which; $R^1$ is a saturated or a mono- or polyunsaturated alkyl radical having 8 to 22 C atoms; each of $R^2$ and $R^3$ independently of each other is an alkyl or hydroxyalkyl radical having 1 to 8 C atoms or an aryl or alkylaryl radical having 6 to 10 C atoms; $R^4$ is an alkyl or hydroxyalkyl radical having 1 to 8 C atoms, an aryl or alkylaryl radical having 6 to 10 C atoms, or an $—O^-$ radical; $X^-$ is a monovalent anion or a monovalent equivalent of a polyvalent anion; a is 0 if $R^4$ is an $—O^-$ radical; and otherwise a is 1, b) 0.3 to 1.15 mmol/l of one or more mono-, di- or tri-basic hydroxycarboxylic acids having 4 to 7 C atoms in the molecule, the sum of hydroxyl and carboxyl groups being at least 3, or anions thereof, c) 0.4 to 2 mmol/l of one or more complex fluorides, d) 20 to 500 mg/l of mineral acids selected from the group consisting of phosphoric acid, nitric acid and sulfuric acid, and anions thereof, and e) 100 to 400 mg/l of tannin, and in which at least one of the immediately following four conditions is satisfied:

component a) is an amine oxide or a quaternary ammonium salt in which $R^1$ represents a mixture of alkyl groups having the same numbers of the same alkyl groups as are present in primary amines made by reducing with ammonia and hydrogen a fatty acid mixture which has been obtained by hydrolysis of coconut oil, palm kernel oil or animal tallow;

component b) is selected from the group consisting of mono- and di-basic hydroxycarboxylic acid molecules having 6 C atoms and at least 4 hydroxyl groups per molecule;

component c) is hexafluorozirconic acid; and component d) comprises phosphoric acid or anions thereof to an extent of 10 to 100% by weight;

and in which, in addition, at least one of the following two conditions is satisfied:

component a) is selected from the group consisting of quaternary ammonium salts in which $R^2$, $R^3$ and $R^4$ are hydroxyalkyl groups having 1 to 4 C atoms; and component b) is gluconic acid or anions thereof.

10. A process for production of a corrosion-protective, friction-reducing, protective layer, which improves the ability to be enameled, on surfaces of aluminum or tin or alloys thereof, which process comprises bringing the surfaces into contact with an aqueous solution as claimed in claim 6, which aqueous solution has a temperature in the range from 30 to 60° C., for a period of between 10 and 120 seconds.

11. The process as claimed in claim 10, wherein the metal surfaces are surfaces of cans of aluminum or aluminum alloys.

12. An aqueous solution as claimed in claim 1, in which at least one of the following conditions is satisfied:

component a) is an amine oxide or a quaternary ammonium salt in which $R^1$ represents a mixture of alkyl groups having the same numbers of the same alkyl groups as are present in primary amines made by reducing with ammonia and hydrogen a fatty acid mixture which has been obtained by hydrolysis of coconut oil, palm kernel oil or animal tallow;

component b) is selected from the group consisting of mono- and di-basic hydroxycarboxylic acids having 6 C atoms and at least 4 hydroxyl groups;

component c) is hexafluorozirconic acid; and component d) comprises phosphoric acid or anions thereof to an extent of 10 to 100% by weight.

13. An aqueous solution as claimed in claim 1, in which at least one of the following conditions is satisfied:

component a) is selected from the group consisting of quaternary ammonium salts in which $R^2$, $R^3$ and $R^4$ are hydroxyalkyl groups having 1 to 4 C atoms; and component b) is gluconic acid or anions thereof.

14. An aqueous solution as claimed in claim 1, which comprises component a) in a concentration of 0.5 to 1.1 mmol/l or component by in a concentration of 0.3 to 1.15mmol/l.

15. An aqueous solution as claimed in claim 1, which comprises tannin in a concentration of 100 to 400 mg/l.

16. An aqueous solution as claimed in claim 1, which additionally comprises water-soluble or water-dispersible polymers in a concentration of 100 to 1000 mg/l.

17. An aqueous solution as claimed in claim 16, in which the water-soluble or water-dispersible polymers are selected from the group consisting of h) homo- and hetero-polymers of ethylene oxide, propylene oxide and butylene oxide, i) homo- and hetero-polymers of acrylic acid, maleic acid and derivatives thereof, k) homo- and hetero-polymers of vinylphenol and products of Mannich reactions of homo- and hetero-polymers of vinylphenol, aldehydes, and alkyl amines, and l) homo- and hetero-polymers of vinyl alcohol and vinyl alcohol derivatives.

18. An aqueous concentrate which, after being diluted with water in a volume ratio of between 1:50 and 1:200, produces an aqueous solution comprising:

a) 0.14 to 2.25 mmol/l of a component chosen from surface-active quaternary ammonium salts or amine oxides of the general formula (I):

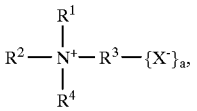

$$R^2-\underset{R^4}{\overset{R^1}{N^+}}-R^3-\{X^-\}_a, \quad (I)$$

in which; $R^1$ is a saturated or a mono- or polyunsaturated alkyl radical having 8 to 22 C atoms; each of $R^2$ and $R^3$ independently of each other is an alkyl or hydroxyalkyl radical having 1 to 8 C atoms or an aryl or alkylaryl radical having 6 to 10 atoms; $R^4$ is an alkyl or hydroxyalkyl radical having 1 to 8 C atoms, an aryl or alkylaryl radical having 6 to 10 C atoms, or an $—O^-$ radical; $X^-$ is a monovalent anion or a monovalent equivalent of a polyvalent anion; a is 0 if $R^4$ is an $—O^-$ radical; and otherwise a is 1, b) 0.25 to 1.5 mmol/l of one or more mono-, di- or tri-basic hydroxycarboxylic acids having 4 to 7 C atoms in each molecule, the sum of hydroxyl and carboxyl groups being at least 3, or anions thereof, c) 0.4 to 2 mmol/l of one or more complex fluorides and d) 20 to 500 mg/l of mineral acids selected from the group consisting of phosphoric acid, nitric acid and sulfuric acid, and anions thereof.

19. A process for production of a corrosion-protective, friction-reducing, protective layer, which improves the ability to be enameled, on surfaces of aluminum or tin or alloys thereof, which process comprises bringing the surfaces into contact with an aqueous solution as claimed in claim 1, which aqueous solution has a temperature in the range from 30 to 60° C., for a period of between 10 and 120 seconds.

20. The process as claimed in claim 19, wherein the metal surfaces are surfaces of cans of aluminum or aluminum alloys.

* * * * *